United States Patent [19]

Rodzewich

[11] 3,975,215

[45] Aug. 17, 1976

[54] CLEANER FOR TIN PLATED FERROUS METAL SURFACES

[75] Inventor: Edward A. Rodzewich, Flourtown, Pa.

[73] Assignee: Amchem Products, Inc., Ambler, Pa.

[22] Filed: Mar. 26, 1975

[21] Appl. No.: 562,285

Related U.S. Application Data

[62] Division of Ser. No. 405,187, Oct. 10, 1973, Pat. No. 3,888,783.

[52] U.S. Cl. ..... 148/6.17; 148/6.15 R; 252/135; 134/2; 134/29; 427/327

[51] Int. Cl.[2] ..... C23F 7/08

[58] Field of Search ..... 148/6.15 R, 6.17; 252/135; 134/2, 28, 29, 42; 427/327

[56] References Cited

UNITED STATES PATENTS

| | | | |
|---|---|---|---|
| 3,436,350 | 4/1969 | Schwedler | 252/135 |
| 3,645,905 | 2/1972 | Rosenfeld et al. | 252/135 X |
| 3,741,747 | 6/1973 | Hamilton et al. | 148/6.15 R |
| 3,782,906 | 1/1974 | Pierce | 252/135 X |
| 3,839,099 | 10/1974 | Jones | 148/6.15 R |
| 3,888,783 | 6/1975 | Rodzewich | 252/135 |

*Primary Examiner*—Ralph S. Kendall

*Attorney, Agent, or Firm*—E. G. Szoke; M. E. Zall; R. S. Tong

[57] ABSTRACT

A composition and method for treating tin-plated ferrous metal surfaces to remove oils and other contaminants in the form of soil thereon, without etching the surface. Particularly, this invention relates to a composition and method for cleaning drawn and ironed tin-plated ferrous metal containers.

10 Claims, No Drawings

CLEANER FOR TIN PLATED FERROUS METAL SURFACES

This is a division of application Ser. No. 405,187, filed Oct. 10, 1973, now U.S. Pat. No. 3,888,783.

Containers used in the food stuff industry can be made of tin-plated ferrous metal. These containers are ordinarily formed through a process referred to as "drawing and ironing", that is the tin-plated metal sheeting is drawn and intentionally thinned to form a drawn sheet providing uniform wall thickness and producing a thin walled, thick bottomed container. Due to the high cost of tin-plate, only a thin layer of tin-plating is employed.

During fabrication and forming the tin-plated ferrous metal container, lubricants are employed to facilitate the drawing and ironing operation. The lubricants which are deposited on the metal surface usually consist of various types of mineral and vegetable oils and heavy metal soaps.

A serious problem with drawn and ironed tin-plated containers is that the drawing operation stretches the interior tin-plate surface thereby producing pores which leave the underlying ferrous metal surface exposed. In order to clean the surface and remove the lubricants therefrom, cleaners have been employed which not only remove the lubricant but etch the tin-plated ferrous surface which aggravates the problem of corrosion of the exposed steel surface through the pores leaving unsightly rust marks. Moreover, as the containers are processed during manufacture, after the drawing the ironing step and the cleaning step, conditions on the processing line, such as line stoppage, can lead to corrosion of the exposed ferrous surface, rendering the containers unacceptable for use. Any corrosion and blemishes formed on the surface will adversely affect the adhesion of any subsequent conversion coating or sanitary lacquer coating which is applied thereafter.

A variety of cleaning compositions have been employed in the art to treat tin-plated ferrous metal surfaces in order to effect removal of the lubricants and forming oils on the surface. The use of cleaning compositions which etch the surface at the same time removal of the lubricants is effected, are unsuitable due to the acceleration of corrosion of the surface. In addition, cleaning compositions known to the art have not provided protection of the tin-plate surface subsequent to the cleaning step and prior to any further treatment such as conversion coating or sanitary lacquer coating.

This invention provides compositions for use in aqueous solutions to remove the lubricants employed to facilitate the drawing and ironing operation, without etching the metal surface. The present invention also prevents corrosion of the exposed areas of ferrous metal for prolonged periods of time prior to any subsequent treatment such as conversion coating, or organic or sanitary lacquer finishing.

The principal object of the present invention is to provide compositions, solutions, and a process for cleaning tin-plated ferrous metal surfaces, in order to provide a clean surface suitable for subsequent finishing treatments such as conversion coating and siccative finish coating.

A particular object of this invention is to provide a cleaning solution for effectively removing lubricants from drawn and ironed tin-plated ferrous metal containers without etching the surface.

A concomitant object of this invention is to provide novel cleaning compositions and a method for their use for removing lubricants from drawn and ironed tin-plated ferrous metal surfaces wherein the metal surface is so conditioned that further surface treatment can be easily performed.

I have discovered that a cleaning composition consisting of metasilicate, condensed phosphate, and sodium borate when added to water, will form an aqueous cleaning solution which effectively cleans tin-plated ferrous metal surfaces without etching the surface.

It should be understood that the term "ferrous metal" used herein includes iron, iron alloys, and a wide variety of steels. The term "lubricants" or "lubricating material" used herein means deposits formed on the metal surface during the drawing and ironing step, which include various types of mineral or vegetable oils and heavy metal soaps.

The term "cleaning composition" employed herein means the dry admixture of metasilicate, condensed phosphate, and Borax which, when added to water, is suitable for use in the process of the present invention. The term cleaning solution employed herein, means an aqueous solution formed from the addition of the dry cleaning composition to water, and comprises silicate, condensed phosphate, and Borax, said solution suitable in the cleaning process of the present invention.

It will be appreciated that the metasilicates to be employed include the alkali metal metasilicates selected from the group consisting of sodium and potassium. The addition of the alkali metal metasilicate to the cleaning solution not only increases the detergency of the solution rendering it more effective in removing the lubricating materials, but the silicate also provides added protection of the surface from corrosion prior to conversion coating. The silicate is also an excellent saponifying agent for the lubricating oils and the residual loose dirt on the surface.

Typical examples of the alkali metal metasilicates which can be used are sodium metasilicate, and potassium metasilicate. In the preferred practice of the present invention, anhydrous sodium metasilicate should be employed in the cleaning composition in order to prepare the aqueous cleaning solution. The sodium metasilicate is easily dissolved in water and it offers the properties of high alkalinity and good detergency.

The condensed phosphate is an alkali metal phosphate selected from the group consisting of tripolyphosphate and pyrophosphate. Typical examples of the alkali metal condensed phosphates which can be employed in the composition are sodium tripolyphosphate and sodium pyrophosphate. In the preferred practice, sodium tripolyphosphate should be employed.

The borax in the cleaning composition can be in any suitable form, and preferably should be present as sodium borate or sodium tetraborate pentahydrate.

The relative amounts of alkali silicate, condensed phosphate and borax in the dry composition, expressed as a weight ratio, can be from about 0.1 to about 0.5 parts by weight of alkali metasilicate for each part by weight of borax, and from about 0.1 to about 0.6 parts by weight of condensed phosphate for each part by weight of borax.

When the cleaning solution is prepared, the dry admixture or cleaning composition should be added to water in sufficient amounts to produce a cleaning solution consisting of from about 0.75 grams/liter to about 3.0 grams/liter of alkali metal metasilicate, from about 0.75 grams/liter to about 7.5 grams/liter of alkali metal condensed phosphate, and from about 3 grams/liter to about 15 grams/liter of borax. It should be understood that in the preferred embodiment of the present invention, as specified hereinabove, the silicate portion of the cleaning composition is comprised of sodium metasilicate and the condensed phosphate portion of the cleaning composition is comprised of sodium tripolyphosphate. Pyrophosphate can be substituted for the tripolyphosphate thereby producing a substantially equivalent cleaning composition and cleaning solution, in which case the concentrations of this material present in the cleaning solution should correspond to that specified hereinabove when sodium tripolyphosphate is employed. The foregoing concentration parameters are calculated on the basis of the sodium form of metasilicate and the sodium form of tripolyphosphate. As has been stated hereinabove, in the preferred embodiment of this invention the sodium salts are selected for use, but other alkali salts such as potassium salts can be substituted.

Surfactants and foaming agents are desirably included in the cleaning composition. Such materials enhance the cleaner performance but are not the essence of the invention since they are used to perform functions essentially similar to the function they perform in prior art solutions. Typical examples of surfactants and wetting agents which can be employed in the cleaning composition are ethoxylated straight chained alcohols and octyl or nonyl phenoxy polyethoxyethanol. Preferably, non-ionic surface active agents should be employed in the cleaning solution.

Typical examples of cleaning compositions suitable for dilution with water to make cleaning solutions of optimum quality having constituent concentrations and operating parameters in the ranges set forth herein, are as follows:

FORMULA I

| | % by weight |
|---|---|
| Sodium tripolyphosphate (anhydrous) | 25 |
| Sodium metasilicate (anhydrous) | 10 |
| Sodium tetraborate pentahydrate | 53 |
| Nonionic surfactants ( NEODOL 25-9 and MAKON NF-12) | 12 |

FORMULA II

| | % by weight |
|---|---|
| Sodium tripolyphosphate (anhydrous) | 20 |
| Sodium metasilicate (anhydrous) | 15 |
| borax pentahydrate | 53 |
| nonionic surfactants (NEODOL 25-9 and MAKON NF-12) | 12 |

FORMULA III

| | % by weight |
|---|---|
| Sodium tripolyphosphate (anhydrous) | 20 |
| Sodium metasilicate (anhydrous) | 20 |
| borax pentahydrate | 48 |
| nonionic surfactants (NEODOL 25-9 and MAKON NF-12) | 12 |

FORMULA IV

| | % by weight |
|---|---|
| Tetrasodium pyrophosphate | 25 |
| Sodium metasilicate | 10 |
| borax pentahydrate | 53 |
| nonionic surfactants (NEODOL 25-9 and MAKON NF-12) | 12 |

FORMULA V

| | % by weight |
|---|---|
| Sodium tripolyphosphate (anhydrous) | 26 |
| Sodium metasilicate (anhydrous) | 20 |
| borax pentahydrate | 48 |

-continued

| | |
|---|---|
| nonionic surfactants (NEODOL 25-9 and MAKON NF-12) | 06 |

FORMULA VI

| | % by weight |
|---|---|
| Sodium Tripolyphosphate | 10 |
| Sodium metasilicate | 20 |
| borax pentahydrate | 58 |
| nonionic surfactants | 12 |

The cleaning solution can be applied to the substrate utilizing any contacting technique known to the art. Preferably application will be effected by conventional spray or immersion methods. The time of treatment of the tin-plated ferrous metal surface with the cleaning solution need only be long enough to insure complete wetting of the surface and can be as long as 20 minutes. Preferably, the surface should be treated for a time from about 15 seconds to about 1 minute. A surprising aspect of the present invention is that the cleaning solution can be contacted with the tin-plated ferrous metal surface for a period as long as 20 minutes without causing any etching of the surface with a resulting loss in luster and staining of the surface. This is an important advantage especially on commercial processing lines, where line stoppage or breakdown readily occurs thereby causing the cleaning solution to spray the tin-plated ferrous metal containers for long periods of time. The present invention permits long spray times without attack of the metal surface, wherein surface attack is prevented without the use of chromates.

The cleaning solution can be operated at temperatures as high as 190°F. It is preferred that the cleaning process be operated at temperatures from about 150°F to about 170°F.

The cleaning solution is highly alkaline having a pH above about 9.0. The pH of the cleaning solution should be maintained at a level within the range of from about 9.0 to about 10.5.

During the cleaning operation, depletion of the constituents in the cleaning solution will occur due to factors such as drag-out and the action of the constituents on the lubricating oils and loose dirt. For example, the silicate will be expended during its saponifying and detergent action. Simple titration methods can be employed in order to determine the concentrations of the condensed phosphate and silicate in solution. For example, the cleaning bath is maintained within its prescribed operating parameters with suitable additions of the constituents therein by separate additions of each constituent, when necessary, or by addition of a replenishing composition having the constituents in the same proportions in which they exist in the make-up cleaning composition.

The cleaning process can be accomplished by treating the tin-plated ferrous metal surface after the drawing and ironing step. Generally, it is not necessary that the surface undergo any preliminary treatment prior to contact with the cleaning solution. The cleaning process is accomplished directly after the forming operation or a short period of time thereafter.

Following the application of the cleaning solution, the surface is completely water-break-free. A water-break-free surface is completely free of lubricants, soil, and other contaminants and will maintain a continuous film of water.

Subsequent to the cleaning procedure, the metal surface is usually rinsed with water. The water rinse is necessary to remove any remaining residues which may have remained after the cleaning step.

Subsequent to the cleaning process, the metal surface can be contacted with a coating solution to provide a corrosion resistant coating which also enhances the adhesion of a later applied organic, sanitary lacquer, siccative finish or the like.

It has been discovered that when a coating solution comprising a primary and/or secondary phosphate, a hydroxylamine salt, and a fluoride salt is applied to a drawn and ironed tin-plated ferrous metal container, following the cleaning process of the present invention, excellent corrosion resistant coatings are obtained. Optimum corrosion resistance and sanitary lacquer adhesion has been obtained when a coating solution comprising monosodium and disodium monophosphate, hydroxylammonium acid sulfate, and ammonium bi-fluoride having the following formula is applied to the surface:

| | % by weight |
|---|---|
| Monosodium Monophosphate | .65–.85 |
| Disodium Monophosphate | .65–.85 |
| Hydroxylammonium Acid Sulfate | .07–.05 |
| Ammonium Bifluoride | .03–.05 |
| Water | 97.03–98.06 |

The surface which has been rendered clean and water break-free after the cleaning step of the present invention, when contacted with the coating solution described above maintains its original appearance, that is a highly polished look having improved corrosion resistance and adhesion of a later applied sanitary lacquer or the like.

A particular advantage of the present invention is that after the cleaning step has been accomplished, the tin-plated ferrous metal surface will not suffer corrosive attack when subjected to prolonged exposure to air prior to application of the conversion coating.

The examples presented below are illustrative of this invention and are not considered as limiting for other materials and operating conditions falling within the scope of this invention that might be substituted.

EXAMPLE 1

Tin-plated drawn and ironed steel containers were employed in this procedure. A cleaning solution was prepared by adding 15 grams of the composition of Formula I to 1 liter of water, with stirring such that complete dissolution of the constituents was achieved. The pH of the solution was measured at 9.5.

The test containers were sprayed with the solution for a period of twenty minutes at 40 psi and at a temperature of about 160°F. After treatment, the containers were rinsed with water and visually observed for etching, gloss, and detinning. The test containers had a bright, rust free appearance with no tin loss or etching.

EXAMPLE 2

Tin-plated steel containers were employed in this procedure. Test solutions were prepared employing the compositions of Formulas I, II, III, and IV. Each of the aqueous cleaning solutions were prepared by adding 15 grams of each of Formulas I, II, III, and IV to 1 liter of water. The pH of the resulting cleaning solutions were measured and are listed in Table 2 below. Sets of test containers were sprayed at 40 psi with the respective solutions for a period of one minute. Other sets of test containers were sprayed with each respective solution at 40 psi for a period of twenty minutes. The temperature of the cleaning solutions was maintained at 180° F.

After treatment the containers were visually observed for etching and for appearance. The results are listed in Table 2 below.

TABLE 2

| | Cleaning Solution | Treatment Time | pH | Observation Results |
|---|---|---|---|---|
| a) | Formula I | 1 minute | 9.5 | no detinning, clean, bright, rust-free surface |
| | | 20 minutes | | no detinning, clean, bright, rust-free surface |
| b) | Formula II | 1 minute | 9.7 | no detinning, clean, bright, rust-free surface |
| | | 20 minutes | | no detinning, clean, bright, rust-free surface |
| c) | Formula III | 1 minute | 9.9 | no detinning, clean, bright, rust-free surface |
| | | 20 minutes | | no detinning, clean, bright, rust-free surface |
| d) | Formula IV | 1 minute | 9.5 | no detinning, clean, bright, rust-free surface |
| | | 20 minutes | | no detinning, clean, bright, rust-free surface |

EXAMPLE 3

Tin-plated steel panels were cleaned with a solution prepared as in Example 1 by spraying the containers at 5 psi for 45 seconds at 150°F. After cleaning had been accomplished the containers were then sprayed with an aqueous coating solution having the following constituents:

| | % by weight |
|---|---|
| Mono-sodium monophosphate | .53 |
| Disodium monophosphate | .47 |
| Hydroxylammonium acid sulfate | .12 |
| Ammonium bifluoride | .06 |
| Water | 98.82 |

The pH of the above solution was measured at 5.2. The solution was applied to the containers at a pressure of about 5 psi and at a temperature of about 90°F. for 45 seconds. The containers were then rinsed with water, followed by a dionized water rinse and dried at ambient temperature. The containers were visually observed and retained a rust-free and bright appearance after treatment.

An acrylic white base paint (Celanese 641–481) was thereafter applied to the test specimens. The test specimens were then subjected to an immersion test. In this procedure, the painted test specimens are immersed in boiling deionized water for 30 minutes. The specimens are removed from the boiling water and rinsed, then blotted dry. Portions of each of the test specimens are immediately scribed with a cross-hatch tool having eleven cutting blades spaced one millimeter apart. Using the cross-hatch tool, one hundred squares measuring one millimeter by one millimeter are scribed on the painted surface. This is accomplished by drawing the scribing device across the area to be tested and then repeating the procedure by drawing the device across the same area but at a 90° angle to the first scribing. The cross-hatched area is subjected to a tape adhesion test wherein tape is applied firmly to the surface of the test specimen over the entire cross-hatched area so that no air bubbles or wrinkles are present between the tape and the surface. The tape is allowed to set for one minute and is then drawn back against itself with a rapid pulling motion in a manner such that the tape is pulled from the surface of the specimen.

The test specimens showed excellent paint adhesion with little or no paint loss.

I claim:

1. A method for cleaning tin-plated ferrous metal surfaces comprising contacting the surfaces with a cleaning solution having a pH from about 9 to about 10.5, said solution consisting essentially of an alkali metasilicate in an amount from about 0.75 grams/liter to about 3.0 grams/liter, a condensed phosphate present in an amount from about 0.75 grams/liter to about 7.5 grams/liter, the condensed phosphate selected from the group consisting of alkali metal tripolyphosphate and alkali metal pyrophosphate, and sodium borate present in an amount from about 3 to about 15 grams/-liter.

2. The process of claim 1 wherein the alkali metal metasilicate is sodium metasilicate.

3. The process of claim 1 wherein the condensed phosphate is sodium tripolyphosphate.

4. The process of claim 1 wherein the surfaces are contacted with the cleaning solution by spraying.

5. The process of claim 4 wherein spraying of the surfaces are continued for a time period sufficient to insure complete wetting of the surfaces.

6. The process of claim 5 wherein the surfaces are sprayed for a period of time not to exceed about 20 minutes.

7. The process of claim 5 wherein the surfaces are sprayed for about 15 to 60 seconds.

8. The process of claim 1 operated at a temperature not to exceed about 190°F.

9. The process of claim 8 operated at a temperature from about 150°F to about 170°F.

10. A method for treating tin-plated ferrous metal surfaces comprising the steps of:

a. cleaning the surface by contacting it with a solution having a pH from 9 to about 10.5, said solution consisting essentially of an alkali metasilicate in amount from about 0.75 grams/liter to about 3.0 grams/liter, an alkali metal condensed phosphate present in an amount from about 0.75 grams/liter to about 7.5 grams/liter, (and borax) wherein the condensed phosphate is selected from the group consisting of alkali metal, tripolyphosphate and alkali metal, pyrophosphate, and sodium borate present in an amount from about 3 to about 15 grams/liter, b. rinsing the surface with water, c. contacting the rinsed surface with a coating solution consisting essentially of monosodium monophosphate, disodium monophosphate, hydroxylammonium acid sulfate, ammonium bifluoride, and water, d. rinsing the surface with water, e. applying a sanitary lacquer to the surface.

* * * * *